US009125789B2

(12) United States Patent
Garcia

(10) Patent No.: US 9,125,789 B2
(45) Date of Patent: Sep. 8, 2015

(54) KNEE EXTENSION ASSIST DEVICE

(76) Inventor: Felix M. Garcia, Norwood, NJ (US)

( * ) Notice: Subject to any disclaimer, the term of this patent is extended or adjusted under 35 U.S.C. 154(b) by 853 days.

(21) Appl. No.: 13/416,047

(22) Filed: Mar. 9, 2012

(65) Prior Publication Data

US 2012/0232439 A1 Sep. 13, 2012

Related U.S. Application Data

(60) Provisional application No. 61/451,900, filed on Mar. 11, 2011.

(51) Int. Cl.
*A61H 1/02* (2006.01)
*A61H 1/00* (2006.01)

(52) U.S. Cl.
CPC ..... *A61H 1/024* (2013.01); *A61H 1/02* (2013.01); *A61H 1/0237* (2013.01)

(58) Field of Classification Search
CPC ..... A61H 1/02; A61H 1/024; A61H 1/0255; A61H 1/0259
USPC ..... 601/5, 33–35
See application file for complete search history.

(56) References Cited

U.S. PATENT DOCUMENTS

| | | | | |
|---|---|---|---|---|
| 4,834,073 | A | 5/1989 | Bledsoe et al. | |
| 4,974,830 | A | 12/1990 | Genovese et al. | |
| 5,228,432 | A | 7/1993 | Kaiser et al. | |
| 5,280,783 | A | 1/1994 | Focht et al. | |
| 5,399,147 | A * | 3/1995 | Kaiser | 601/34 |
| 6,217,532 | B1 | 4/2001 | Blanchard et al. | |
| 6,267,735 | B1 | 7/2001 | Blanchard et al. | |
| 6,325,770 | B1 * | 12/2001 | Beny et al. | 601/34 |
| 7,282,035 | B2 | 10/2007 | Huang | |
| 7,309,320 | B2 | 12/2007 | Schmehl | |
| 7,874,968 | B2 | 1/2011 | Foucault | |
| 8,425,579 | B1 * | 4/2013 | Edelman et al. | 607/104 |
| 2006/0064044 | A1 * | 3/2006 | Schmehl | 601/34 |

OTHER PUBLICATIONS

Ortho Innovations, Inc., "Mackie Hinge" Static Progressive Knee Brace, brochure, www.orthoinnovations.com. (No Date).
Elite Seat, Kneebourne Therapeutic, www.kneebourne.com; 2008.
Smith & Nephew Kinetec S.A., "Kinetec—Notice Pieces De Rechange Catalogue of Spare Parts", pp. 1-9; 1998.

* cited by examiner

*Primary Examiner* — Justine Yu
*Assistant Examiner* — Christopher Miller
(74) *Attorney, Agent, or Firm* — Hoffmann & Baron, LLP

(57) ABSTRACT

A knee extension assist device that includes: a frame, a support structure, a base and an articulated knee brace. The frame has a first section pivotably connected to a second section by a pair of hinges. The support structure is slidably attached to the frame to provide pivotal movement of the two sections. The base includes a motor that moves the frame between extended and retracted positions. The articulated knee brace receives a patient' leg and has a pair of upper legs connected by a pair of hinges to a pair of lower legs. A pair of shafts connects the hinges in the brace to the hinges on the frame and a pair of connecting members connects the lower legs to the second section of the frame. The pivotal movement of the frame causes a force to be exerted on the soft tissues in the knee of the patient.

20 Claims, 8 Drawing Sheets

KNEE EXTENSION ASSIST DEVICE

This application claims priority from provisional application Ser. No. 61/451,900, filed on Mar. 11, 2011, which is incorporated herein in its entirety.

FIELD OF THE INVENTION

The present invention is a knee extension assist device. In particular, the present invention is an improved passive motion machine with an articulated knee brace that applies a targeted force to the knee joint.

BACKGROUND OF INVENTION

Continuous passive motion ("CPM") is a rehabilitation technique designed to assist in recovery of joint range of motion ("ROM"). CPM provides progressive passive ROM to an extremity through an externally applied force. Passive range of motion means that the joint is moved without the patient's muscles being used. CPM is used to maintain ROM and flexibility in joints in the early postoperative and rehabilitative period after surgery or injury when active movement might disrupt the repair process or is too painful to perform. In most patients after extensive joint surgery, attempts at joint motion cause pain and as a result, the patient fails to move the joint. This causes the tissue around the joint to become stiff and for scar tissue to form resulting in a joint which has limited range of motion and often may take months of physical therapy to recover that motion.

CPM is carried out by a continuous passive motion device, which is a motorized device that gradually and constantly moves the joint through a controlled range of motion. The exact range is dependent upon the joint, but in most cases the range of motion is increased over time. The device contains two parts; a carriage (also referred to herein as a frame) for support of the extremity and a controller that can be programmed for ROM, speed, pause and duration of treatment. During CPM therapy the joint area is secured in the device and the device is programmed to flex and extend the joint passively. CPM use is based on the theory that recovery will be accelerated by decreasing soft tissue stiffness, increasing ROM, promoting healing of joint surfaces in soft tissues and preventing the development of adhesions. Motion and stress are important for the maintenance of normal connective tissue and the healing of injured connective tissue. Motion enhances blood flow and decreases pain. CPM devices enable patients to get back quickly-or never lose-good motion in a joint.

The CPM devices that are currently being used for the treatment of knee injuries provide passive ROM but do not fully stretch the ligaments in the knee. Over the course of the treatment, the ligaments may stiffen. This limits the effectiveness of the treatment and results in longer recovery periods for the patients. Accordingly, there is a need for a device that simultaneously stretches the knee ligaments while at the same time providing passive ROM.

SUMMARY OF THE INVENTION

In accordance with the present invention, a knee extension assist device is provided. The knee extension assist device includes a frame, a support structure, a base, a control module and an articulated knee brace. The frame has a first section pivotably connected to a second section by a pair of hinges. The second section includes two substantially parallel members and, preferably, the two substantially parallel members are connected to the hinges. The first section has a first end and an end connected to the pair of hinges and the second section has an end connected to the pair of hinges and a second end that can have a stirrup with a strap for supporting and securing the patient's foot. The support structure is slidably attached to the first and second sections of the frame to accommodate the pivotal movement of the two sections. The device can also include an adjustable assembly that connects the first end of the first section of the frame to the base. The adjustable assembly allows the knee extension assist device to be adjusted to accommodate the length of the patient's leg and one or more locking means, such as clamps, are used to fixedly position the first section of the frame in relation to the base once it has been adjusted. The lengths of the first and second sections of the frame can also be adjusted according to the length of the leg of the patient.

The base includes a motor connected to the support structure by a linkage that provides bi-directional movement of the support structure to pivotably move the first and second sections of the frame between an extended position and a retracted position. The linkage moves along either a single track or two parallel tracks that are substantially parallel to the longitudinal axis of the frame. The distance that the linkage travels along the tracks determines how far the patient's knee is extended. A control module, preferably a programmable control module, is used to control the operation of the motor and thereby the movement of the frame between the extended and retracted positions.

The articulated knee brace is disposed between the two substantially parallel members of the two sections of the frame and can include first and second articulated members, first and second shafts, first and second hinges, a pair of webs, a pair of straps and first and second connecting members. The first and second articulated members are substantially parallel and each has an upper leg connected to a lower leg by a first hinge and a second hinge, respectively and each articulated member has first and second opposing ends. The first shaft connects the first hinge in the brace to one of the hinges on the frame and the second shaft connects the second hinge to the other hinge on the frame. One of the webs is attached between the upper legs and the other web is attached between the lower legs. Preferably, the webs are located near the opposing ends of the first second articulated members. Similarly, one of the straps is attached between the upper legs and the other strap is attached between the lower legs of the first and second articulated members. The pair of adjustable straps is adapted for securing the leg of the patient above and below the knee. The connecting members attach each of the lower legs to one of the two substantially parallel members of the second section of the frame.

The articulated knee brace is attached to the frame so that the lower legs of the first and second articulated members correspond to the second section of the frame and the upper legs correspond to the first section of the frame. The articulated knee brace is adapted to receive the leg of a patient so that the back of the leg is supported by the webs and the straps are secured over the front of the leg.

As the motor moves the linkage in the track in a bi-directional manner, the support structure, which is connected to the linkage, provides pivotal movement of the first and section sections of the frame. The movement of the lower legs of the articulated knee brace, which are attached to the frame by the connecting members, corresponds to the movement of the second section of the frame. The movement of the upper legs of the articulated knee brace, which are attached to the hinges but not directly to the frame, is independent of the movement of the first section of the frame. The pivotal movement of the frame causes a force to be exerted on the soft tissues in the knee of the patient using the knee extension assist device.

BRIEF DESCRIPTION OF THE FIGURES

The preferred embodiments of the knee extension assist device of the present invention, as well as other objects, features and advantages of this invention, will be apparent from the accompanying drawings wherein.

DETAILED DESCRIPTION OF THE INVENTION

Figure 1:
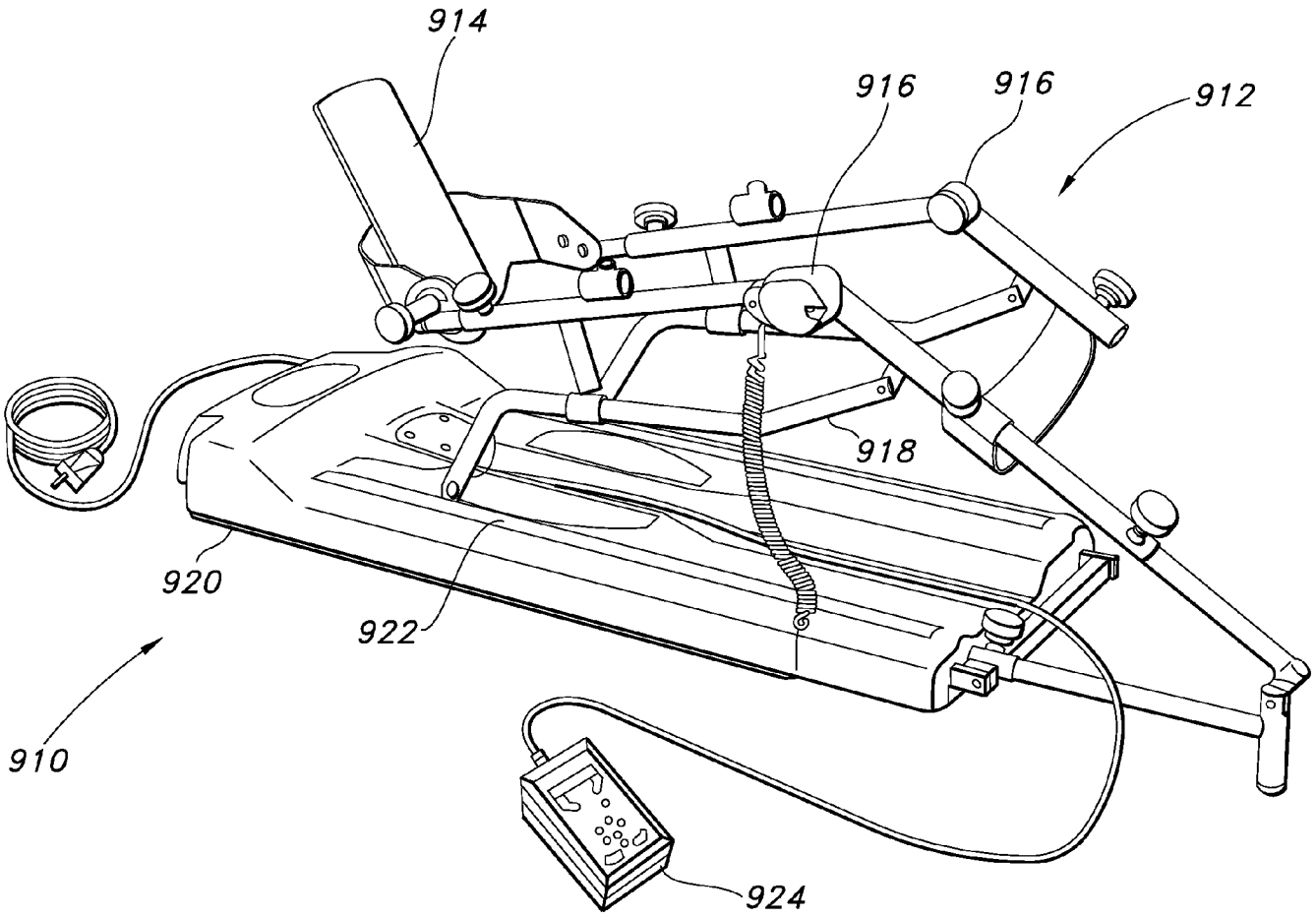
FIG. 1 (PRIOR ART)
FIG. 1 is a perspective side view of a prior art continuous passive motion device.

The present invention is a knee extension assist device (referred to herein as "KEA" device) for knee treatment and rehabilitation in CPM therapy. The KEA device provides static stretch for the treatment of soft tissue contractures by applying a low stretching force over adjustable periods of time with adjustable amounts of force. The KEA device includes a conventional knee CPM device with a specially designed articulated knee brace that stretches the soft tissues of the knee.

A conventional CPM device includes a frame attached to a base by a slidable support structure. The frame cradles a patient's leg and is hinged in the middle at a location corresponding to the position of the patient's knee. The base has a motor that moves the support structure along a track. As the support structure moves in the track, the frame is pivoted at the hinge in a manner that corresponds to the flexing of the patient's knee. Typically, the patient's leg is supported by a web that extends between the opposing sides of the frame and the patient's foot is secured in a stirrup. However, the knee is unsupported and the patient's leg is not secured to the frame. The motor is operated by a control module that is programmed to adjust the movement of the patient's leg and knee. Thus, the patient's knee is exercised as the frame is pivotably moved, but the knee is unrestricted and the tissues are not stretched.

The articulated knee brace of the present invention allows a low stretching force to be applied to the soft tissues of the knee. This treatment is not possible with conventional CPM devices that do not provide a means for stretching the knee tissues. The articulate knee brace has an upper section and a lower section that are pivotably connected by a pair of hinges. The hinges on the articulated knee brace are attached to the hinges on the frame of the CPM device and the lower legs of the articulated knee brace are attached to the corresponding members of the frame. When a patient's leg is positioned in the KEA device, the knee is positioned in the articulated knee brace and rests on webs that extend between the opposing sides of the upper and lower sections and the position of the knee joint corresponds to the pair of hinges. A pair of adjustable straps secures the patient's leg to the upper and lower sections of the articulated knee brace so that, when the knee is flexed, a force is applied to the knee.

The control module controls the operation of the motor and, thus, controls the degree of flexing (i.e., extension and retraction) of the knee as well as the duration of time that the leg is maintained in different positions. The control module controls the rate of movement of the frame between the extended position and the retracted position and can be programmed for ROM, speed, pause and duration of treatment. The programs can progressively increases or decrease the rate of movement of the frame and adjust the time for the cycle between the extended position and the retracted position. As the control module increases distance the linkage travels in the track(s), the extension of the frame increases and the force exerted by the articulated knee brace on the soft tissues of the patient's knee increases.

Referring now to the drawings, FIG. 1 shows a prior art CPM device 910 that includes a frame 912 with two sections and a stirrup 914 for supporting a patient's foot. A pair of hinges 916 in the center connects the two sections of the frame 912 and allows pivotal movement of the two sections of the frame 912. A support structure 918 slidably attaches the frame 912 to a track 922 on a base 920. A motor (not shown) in the base 920 moves the support structure 918 along the track 922, which causes the two sections of the frame 912 to pivot about the hinges 916. A control module 924 is used to control the movement of the frame 912.

Figure 2:
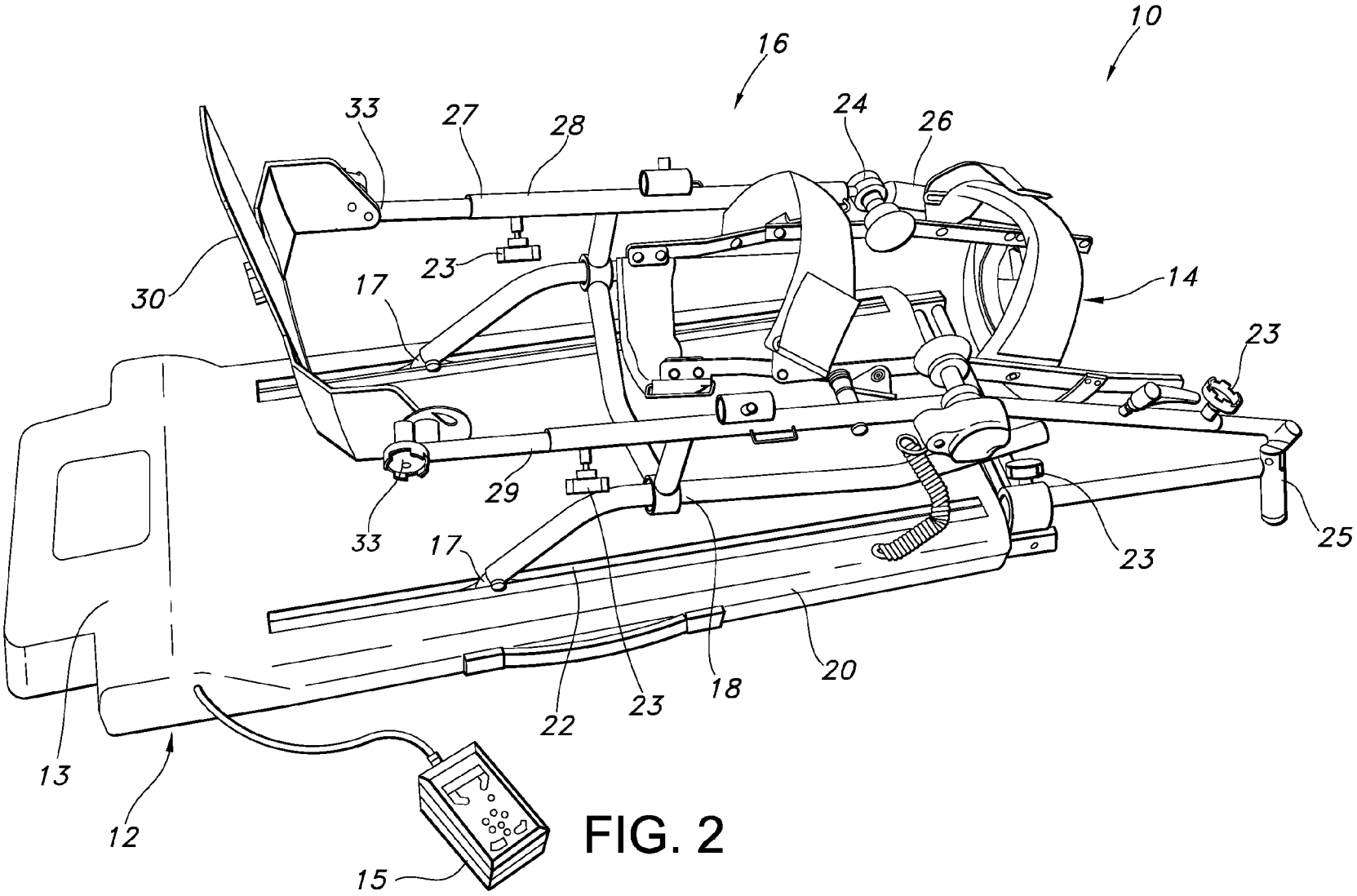
FIG. 2 is a perspective side view of an embodiment of the knee extension assist device of the present invention with an articulated knee brace.
Figure 3:
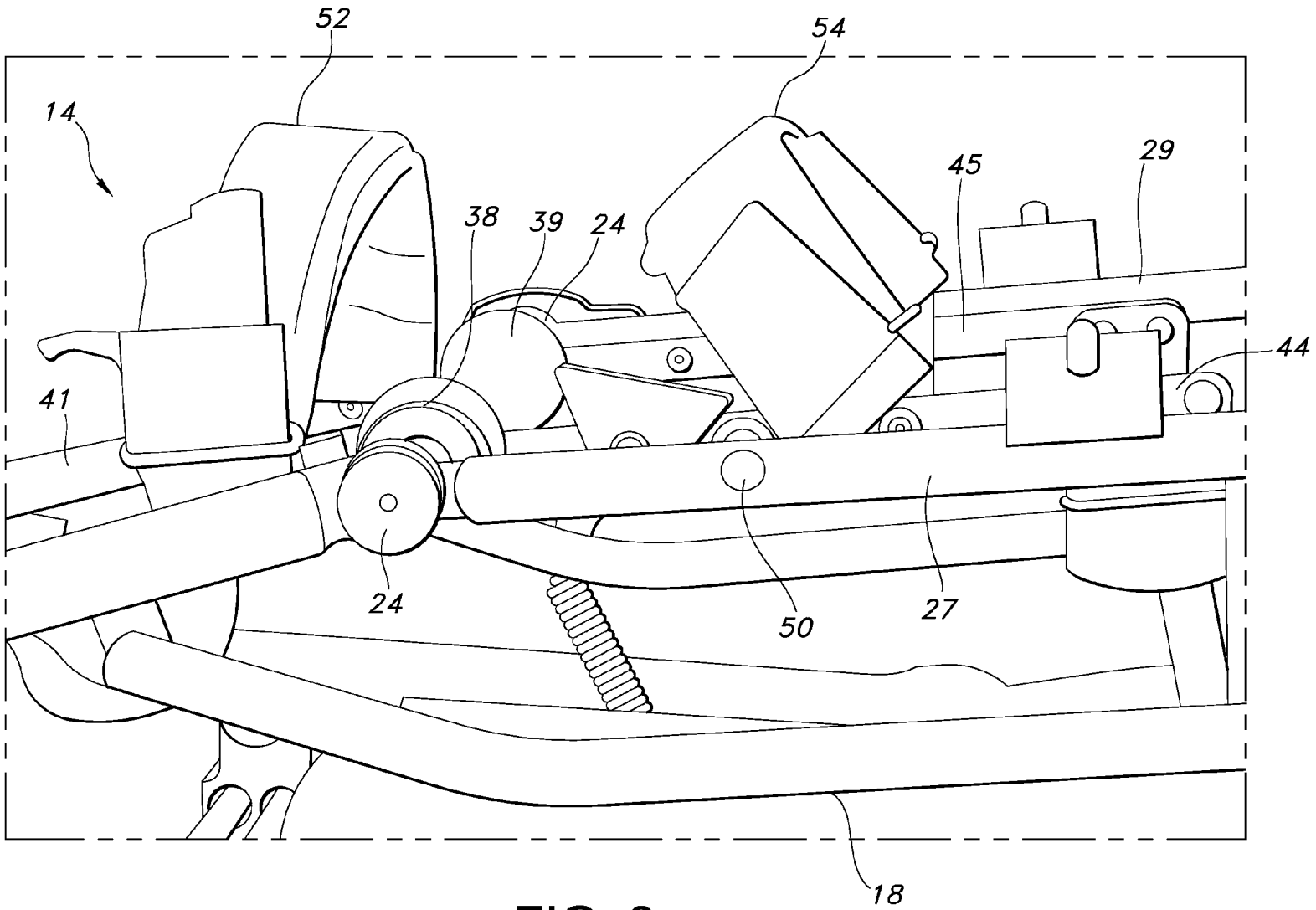
FIG. 3 is a side view of the knee extension assist device shown in FIG. 2 showing the articulated knee brace.

FIGS. 2-10 show the knee extension assist device 10 of the present invention, which includes a CPM device 12 and an articulated knee brace 14. As shown in FIG. 2, the CPM device 12 includes a frame 16 for supporting a patient's leg, a support structure 18 slidably attached to and connecting the frame 16 to a base 20. The frame 16 has a pair of hinges 24 that connects a first section 26 and a second section 28 to provide pivotal movement of the frame 16. The frame 16 supports the leg of a patient and a stirrup 30 receives the patient's foot, which can be secured in the stirrup 30 by an adjustable strap 32. The base 20 includes a motor 13 that is connected to the support structure 18 by a pair of linkages 17, which operably moves the support structure 18 along a pair of tracks 22 to pivotably extend and retract the brace 14 and the frame 16. The distance that the linkages 17 travel in the tracks 22 is adjustable and determines the limits of the extension and retraction. The motor 13 is operated by a control module 15 that can be programmed to change the speed, duration and the distance the linkages 17 travel. In one embodiment (FIG. 8), the base 20 has one track 22 connected to the support structure 18.

As shown in FIG. 2, an adjustable assembly 25 extends from one end of the base 20 and adjustably secures the first section 26 of the frame 16 to the base 20 using one or more securing devices, such as clamps 23. The adjustable assembly 25 changes the length of the first section 26 of the frame 16 to accommodate the different lengths of patients' legs. The second section 27 of the frame 16 can also be adjusted using one or more clamps 23 to change its length to fit the patient.

FIGS. 3-7 and 9 show the articulated knee brace 14, which is formed by a first articulated member 34 that includes an upper leg 40 and a lower leg 44 and a second articulated member 36 that includes an upper leg 41 and a lower leg 45. The upper legs 40, 41 and lower legs 44, 45 of each articulated member 34, 36 are connected by a pair of hinges 38, 39 (FIG.

5), respectively. A first web 42 is attached between the upper legs 40, 41 and a second web 46 is attached between the lower legs 44, 45. The pair of webs 42, 46 supports the back of the patient's leg. The hinges 38, 39 of the articulated knee brace 14 are connected to the hinges 24 of the frame 16 by a pair of shafts 48 so that the frame 16 and the knee brace 14 pivot on a common axis. The lower legs 44, 45 of the articulated knee brace 14 are connected to the opposing sides of the second section 28 of the frame 16 by a pair of connecting members 50 so that the lower legs 44, 45 and the second section 28 of the frame 16 pivot together. However, the upper legs 40, 41 of the articulated knee brace 14 are not connected to the opposing sides of the first section 26 of the frame 16 so that the upper legs 40, 41 of the knee brace 14 and the first section 26 of the frame 16 pivot independently.

Figure 4:
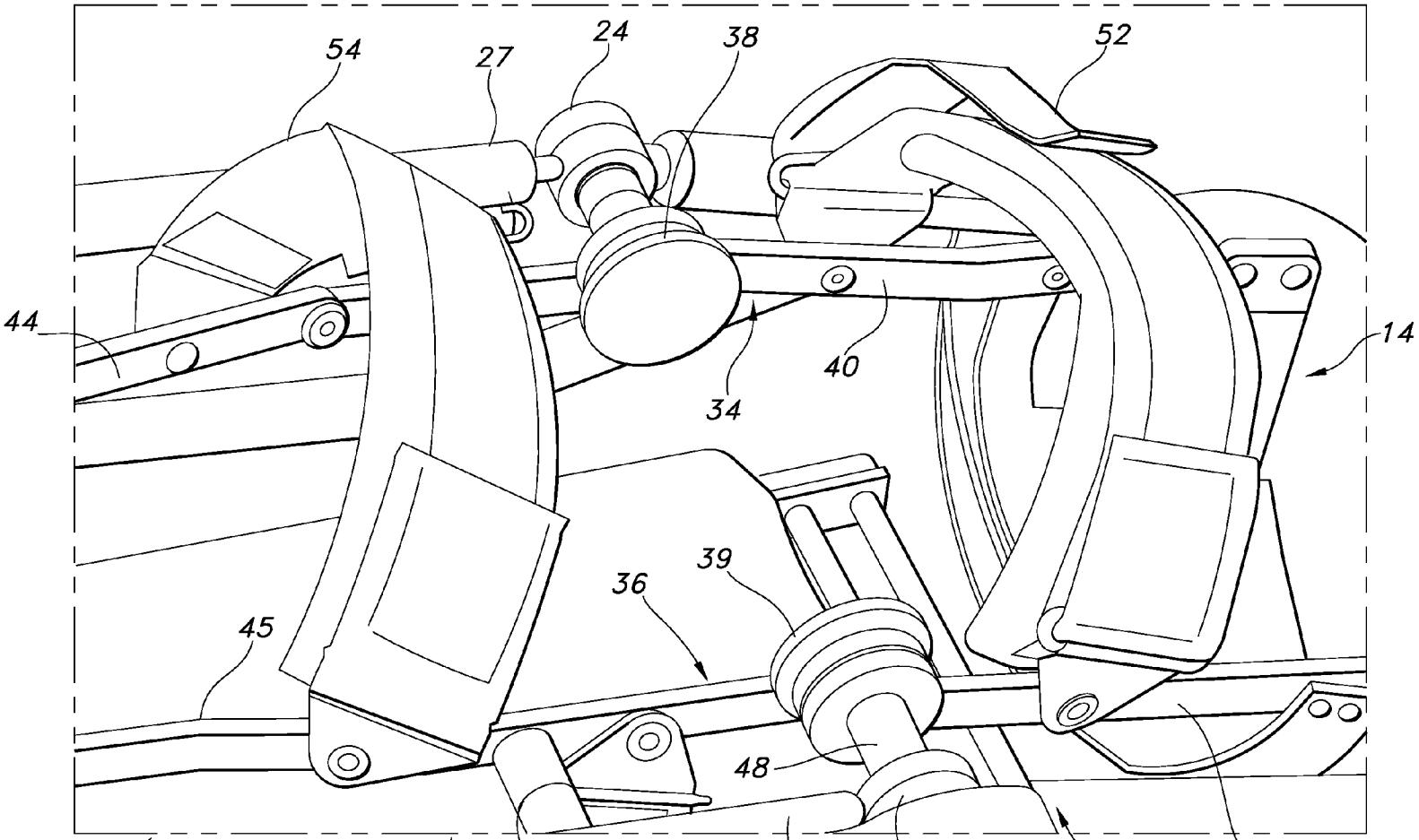
FIG. 4 is a perspective top view of the knee extension assist device shown in FIG. 2 showing the articulated knee brace.

FIG. 4 shows the adjustable straps 52, 54 of the articulated knee brace 14. One strap 52 is attached between the upper legs 40, 41 of the brace 14 and the other strap 54 is attached between the lower legs 44, 45 of the brace 14. After a patient's leg is placed in the articulated knee brace 14, the adjustable straps 52, 54 secure the leg at locations above and below the knee. This ensures that the pivotal movement of the articulated brace 14 will exert a stretching force on the soft tissues of the knee. The amount of force and the duration of the application of the force are dependent on the pivotal movement of the frame 16 and the lower legs 44, 45 of the articulated knee brace 14.

Figure 5:
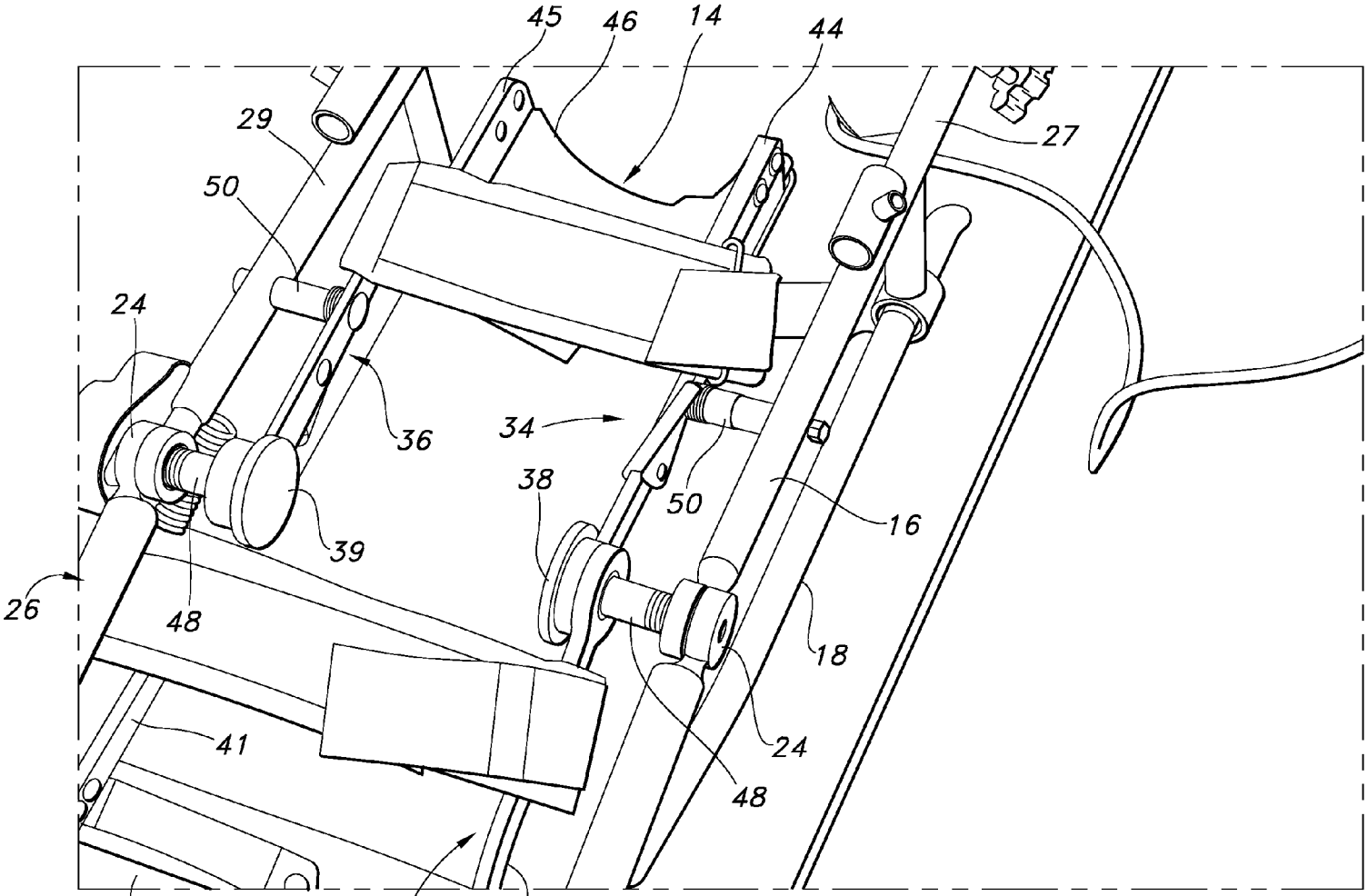
FIG. 5 is a perspective top view of the knee extension assist device shown in FIG. 2 showing the attachment of the articulated knee brace to the frame.
Figure 6:
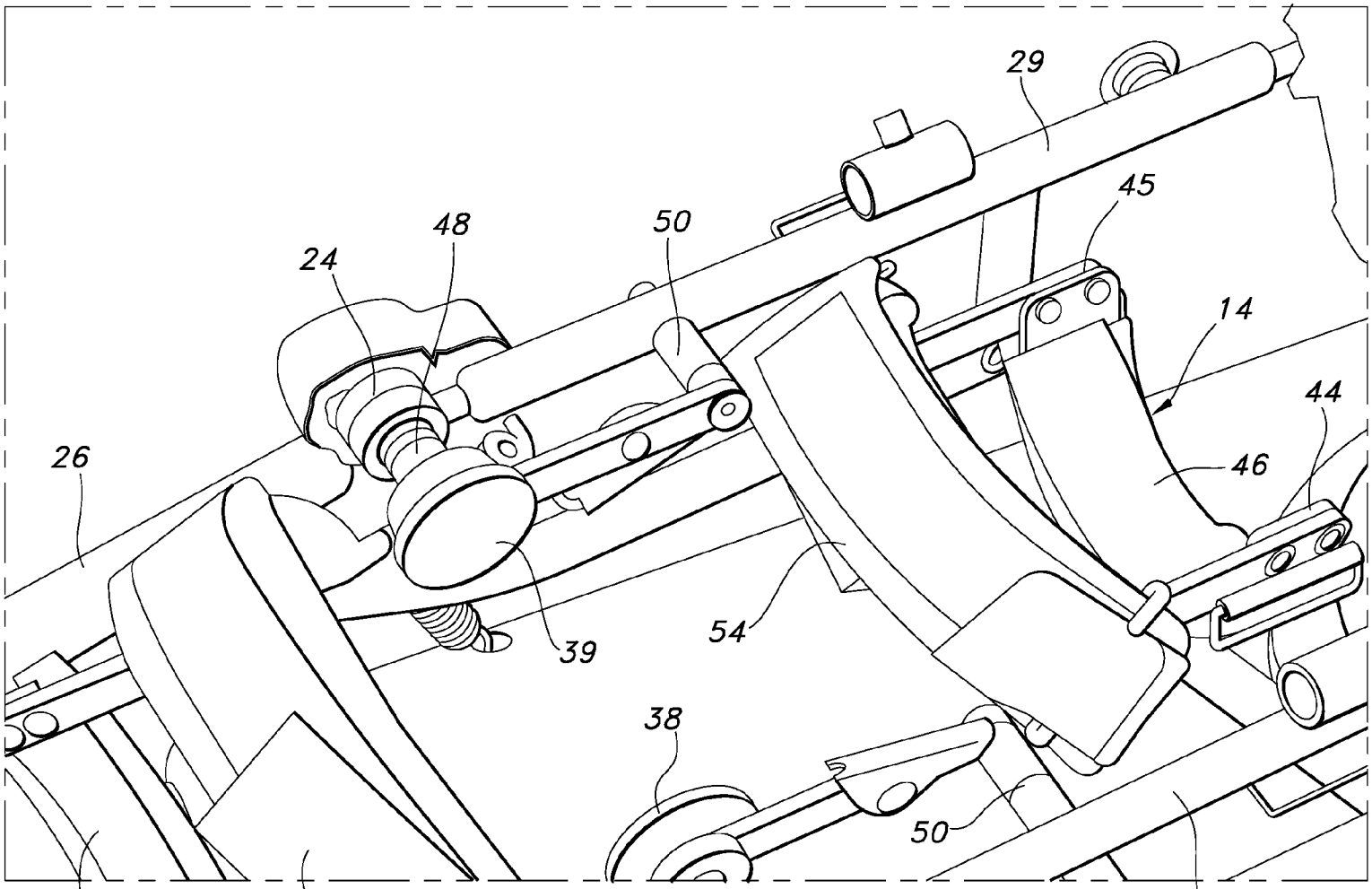
FIG. 6 is a perspective view of the knee extension assist device shown in FIG. 2 showing the articulated knee brace.
Figure 7:
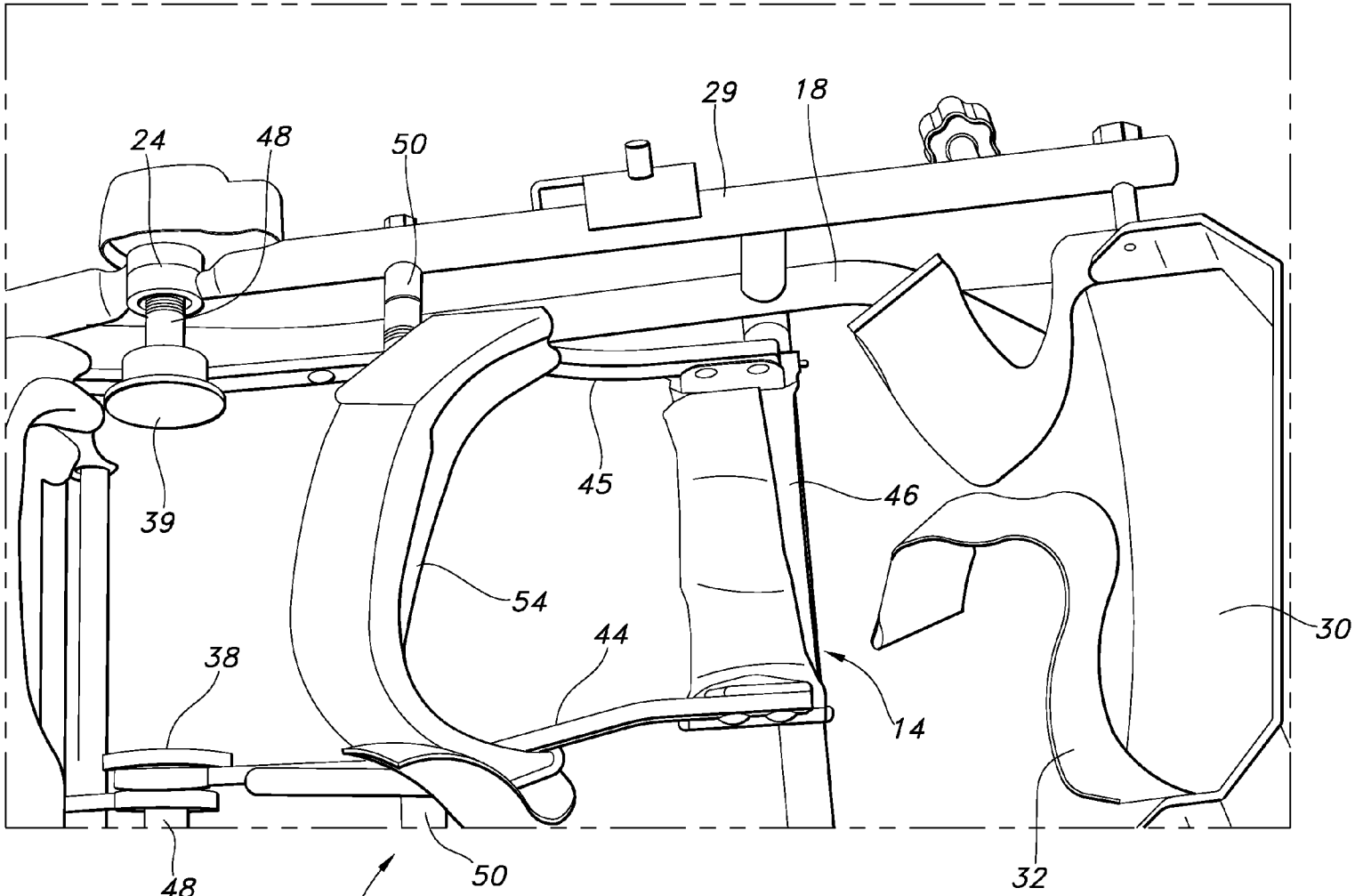
FIG. 7 is a top view of the knee extension assist device shown in FIG. 2 showing the articulated knee brace and the end the frame with the stirrup.
Figure 8:
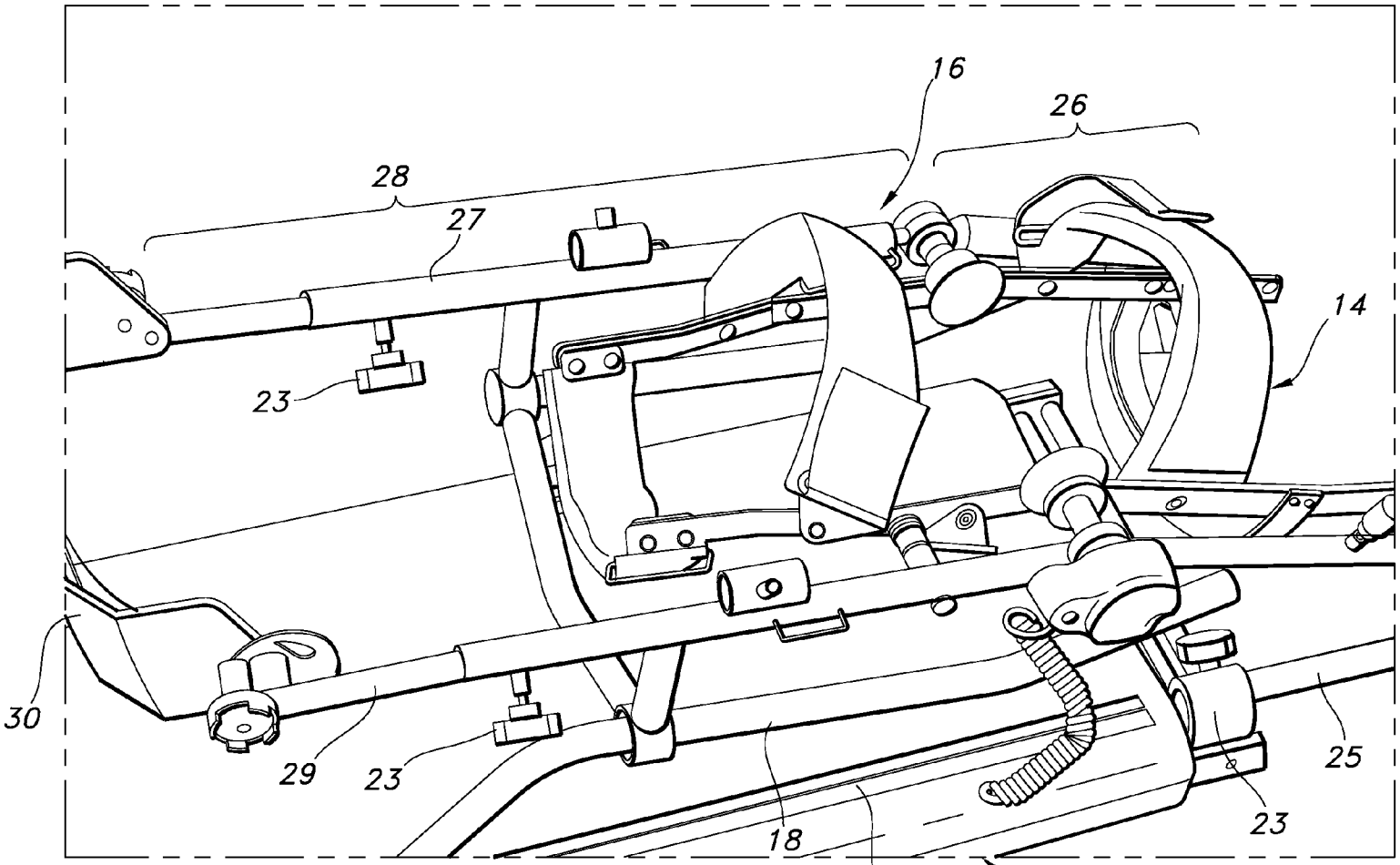
FIG. 8 a perspective side view of the knee extension assist device shown in FIG. 2 showing the articulated knee brace and the adjustable assembly attached to the frame.

FIG. 5 shows how the articulated knee brace 14 is attached to the parallel members 27, 29 of the second section 28 (FIG. 8) of the frame 16. The shafts 48 connect the hinges 38, 39 on the brace 14 to the pair of hinges 24 on the frame 16 so that the articulated knee brace 14 and the frame 16 pivot on a common axis. The lower legs 44, 45 of the articulated knee brace 14 are attached to the frame 16 by a pair of connecting members 50 so that the movement of the second section 28 of the frame 16 corresponds to the movement of the lower legs 44, 45 of the brace. The upper legs 40, 41 are not connected to the frame 16 so that their movement is independent from the movement of the frame 16. FIG. 8 shows an embodiment of the KEA device 10 in which the support structure 18 is connected to one track 22.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

I claim:

1. A knee extension assist device comprising:

a frame having a first section pivotably connected to a second section by a pair of hinges, the first section having a first end and an end connected to the pair of hinges, the second section having an end connected to the pair of hinges and a second end, wherein the second section comprises two substantially parallel members;

a support structure slidably attached to the frame;

a base comprising a motor connected to the support structure; and an articulated knee brace disposed between the two substantially parallel members of the two sections of the frame, the articulated knee brace comprising:

a first articulated member and a second articulated member, each having an upper leg connected to a lower leg by a first hinge and a second hinge, respectively, wherein the first articulated member and the second articulated member are substantially parallel;

a first shaft connecting the first hinge directly to one of the hinges on the frame and a second shaft connecting the second hinge directly to the other hinge on the frame;

a pair of webs, wherein one web is attached between the upper legs and the other web is attached between the lower legs; and first and second connecting members attaching each of the lower legs to one of the two substantially parallel members of the second section of the frame, wherein the articulated knee brace is attached to the frame so that the lower legs of the first and second articulated members correspond to the second section of the frame and the upper legs correspond to the first section of the frame, wherein the brace is adapted to receive the leg of a patient so that the back of the leg is supported by the webs, and wherein, when the motor moves the support structure to provide pivotal movement of the first and section sections of the frame, the movement of the lower legs of the articulated knee brace corresponds to the movement of the second section of the frame and the movement of the upper legs of the brace is independent of the movement of the first section of the frame.

2. The knee extension assist device according to claim 1, wherein the motor is connected to the support structure by a linkage that provides bi-directional movement of the support structure to pivotably move the first and second sections of the frame between an extended position and a retracted position.

3. The knee extension assist device according to claim 1 further comprising a control module for controlling the operation of the motor.

4. The knee extension assist device according to claim 1 further comprising a stirrup attached to the second end of the frame, wherein the stirrup is adapted to receive the patient's foot.

5. The knee extension assist device according to claim 4 further comprising a strap attached to the stirrup, wherein the strap secures the patient's foot in the stirrup.

6. The knee extension assist device according to claim 1, wherein the first and second articulated members of the articulated knee brace each have first and second opposing ends, and wherein the webs are located near the opposing ends.

7. The knee extension assist device according to claim 1, wherein each of the substantially parallel members of the second section of the frame is connected to one of the hinges on the frame.

8. The knee extension assist device according to claim 1 further comprising an adjustable assembly that connects the first end of the first section of the frame to the base.

9. The knee extension assist device according to claim 8, wherein the adjustable assembly is connected to the first section of the frame and comprises one or more locking means for fixedly positioning the first section of the frame in relation to the base.

10. The knee extension assist device according to claim 1, wherein the articulated knee brace further comprises a pair of adjustable straps, wherein one strap is attached between the upper legs of the first and second articulated members and the other strap is attached between the lower legs, and wherein the pair of adjustable straps is adapted for securing the leg of the patient above and below the knee.

11. The knee extension assist device according to claim 1, wherein the first section and the second sections of the frame have an adjustable length, wherein the adjustable length is selected according to the length of the leg of the patient.

12. A knee extension assist device comprising:

a frame having a first section pivotably connected to a second section by a pair of hinges;

a support structure slidably attached to the frame;

a base comprising a motor connected to the support structure by a linkage that provides bi-directional movement of the support structure to pivotably move the first and second sections of the frame between an extended position and a retracted position; and an articulated knee brace disposed within the frame, the articulated knee brace comprising:

a first articulated member and a second articulated member, each having an upper leg connected to a lower leg by a first hinge and a second hinge, respectively, wherein the first articulated member and the second articulated member are substantially parallel;

a first shaft connecting the first hinge directly to one of the hinges on the frame and a second shaft connecting the second hinge directly to the other hinge on the frame;

a pair of webs, wherein one web is attached between the upper legs and the other web is attached between the lower legs;

a pair of adjustable straps, wherein one strap is attached between the upper legs and the other strap is attached between the lower legs of the first and second articulated members; and first and second connecting members attaching each of the lower legs to the second section of the frame, wherein the articulated knee brace is attached to the frame so that the lower legs of the first and second articulated members correspond to the second section of the frame and the upper legs correspond to the first section of the frame, wherein the brace is adapted to receive the leg of a patient so that the back of the leg is supported by the webs, wherein, when the motor moves the support structure to provide pivotal movement between the extended position and the retracted position, and wherein the movement of the lower legs of the articulated knee brace corresponds to the movement of the second section of the frame and the movement of the upper legs of the brace is independent of the movement of the first section of the frame in order to exert a force on the soft tissues in the knee of the patient.

13. The knee extension assist device according to claim 12, wherein the second section is formed by two substantially parallel members that extend between the pair of hinges and a stirrup.

14. The knee extension assist device according to claim 12 further comprising a control module for controlling the operation of the motor.

15. The knee extension assist device according to claim 12 further comprising an adjustable assembly that connects the first end of the first section of the frame to the base and comprises one or more locking means for fixedly positioning the first section of the frame in relation to the base.

16. A knee extension assist device comprising:

a frame having a first section pivotably connected to a second section by a pair of hinges, wherein the first section has a first end and an end connected to the pair of hinges, and wherein the second section has an end connected to the pair of hinges and a second end, and wherein the second section comprises two substantially parallel members;

a support structure slidably attached to the frame;

a base comprising a motor connected to the support structure by a linkage that provides bi-directional movement of the support structure to pivotably move the first and second sections of the frame between an extended position and a retracted position; and an articulated knee brace disposed between the two substantially parallel members of the frame, the articulated knee brace comprising:

a first articulated member and a second articulated member, each having an upper leg connected to a lower leg by a first hinge and a second hinge, respectively, and each articulated member having first and second opposing ends, wherein the first articulated member and the second articulated member are substantially parallel;

a first shaft connecting the first hinge directly to one of the hinges on the frame and a second shaft connecting the second hinge directly to the other hinge on the frame;

a pair of webs, wherein one web is attached between the upper legs and the other web is attached between the lower legs;

a pair of adjustable straps, wherein one strap is attached between the upper legs and the other strap is attached between the lower legs of the first and second articulated members; and first and second connecting members attaching each of the lower legs to one of the two substantially parallel members of the second section of the frame, wherein the articulated knee brace is attached to the frame so that the lower legs of the first and second articulated members correspond to the second section of the frame and the upper legs correspond to the first section of the frame, wherein the brace is adapted to receive the leg of a patient so that the back of the leg is supported by the webs, and wherein, when the motor moves the support structure to provide pivotal movement of the first and section sections of the frame, the movement of the lower legs of the articulated knee brace corresponds to the movement of the second section of the frame and the movement of the upper legs of the brace is independent of the movement of the first section of the frame, whereby a force is adapted to be exerted on the soft tissues in the knee of the patient.

17. The knee extension assist device according to claim 16 further comprising an adjustable assembly that connects the first end of the first section of the frame to the base and comprises one or more locking means for fixedly positioning the first section of the frame in relation to the base.

18. The knee extension assist device according to claim 16 further comprising a programmable control module for controlling the operation of the motor.

19. The knee extension assist device according to claim 16, wherein the first section and second sections of the frame have an adjustable length, wherein the adjustable length is selected according to the length of the leg of the patient.

20. The knee extension assist device according to claim 16 further comprising a stirrup attached to the second end of the frame and a strap attached to the stirrup, wherein the stirrup is adapted to receive the patient's foot and the strap secures the patient's foot in the stirrup.

* * * * *